US006619412B2

(12) United States Patent
Slaughter, Jr. et al.

(10) Patent No.: US 6,619,412 B2
(45) Date of Patent: Sep. 16, 2003

(54) PROTECTED LUBRICANT RESERVOIR FOR SEALED EARTH BORING DRILL BIT

(75) Inventors: Robert H. Slaughter, Jr., Ponca City, OK (US); Peter T. Cariveau, Ponca City, OK (US); Kirk A. Norris, Sand Spring, OK (US); Roger Didericksen, Ponca City, OK (US); William M. Conn, Newton, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/932,540

(22) Filed: Aug. 17, 2001

(65) Prior Publication Data

US 2001/0050187 A1 Dec. 13, 2001

Related U.S. Application Data

(62) Division of application No. 09/484,860, filed on Jan. 18, 2000, now Pat. No. 6,296,067, which is a division of application No. 08/925,869, filed on Sep. 9, 1997, now abandoned.

(60) Provisional application No. 60/025,858, filed on Sep. 9, 1996, and provisional application No. 60/051,373, filed on Jul. 1, 1997.

(51) Int. Cl.[7] ..... E21B 10/22

(52) U.S. Cl. ..... 175/228; 384/93

(58) Field of Search ..... 175/228, 371; 384/93

(56) References Cited

U.S. PATENT DOCUMENTS

| | | | | |
|---|---|---|---|---|
| 1,501,482 A | * | 7/1924 | Hughes | 175/228 |
| 1,909,128 A | | 5/1933 | Scott et al. | |
| 3,007,751 A | | 11/1961 | Eenink | 308/157 |
| 3,017,937 A | * | 1/1962 | Bobo | 166/110 |
| 3,048,230 A | * | 8/1962 | Angel | 175/228 |
| 3,230,019 A | | 1/1966 | Kotch et al. | 308/8.2 |
| 3,230,020 A | | 1/1966 | Gilbert et al. | 308/8.2 |
| 3,299,973 A | | 1/1967 | Swart et al. | 175/371 |
| 3,463,270 A | | 8/1969 | Lundstrom et al. | 184/39 |
| 3,476,195 A | | 11/1969 | Galle | 175/228 |
| 3,719,241 A | | 3/1973 | Bell | 175/228 |
| 3,721,306 A | | 3/1973 | Sartor | 175/228 |
| 3,735,825 A | | 5/1973 | Keller | 175/228 |
| 3,739,864 A | | 6/1973 | Cason, Jr. et al. | 175/228 |
| 3,744,580 A | | 7/1973 | Crow | 175/228 |
| 3,841,422 A | | 10/1974 | Crow | 175/229 |
| 3,844,364 A | | 10/1974 | Crow | 175/228 |
| 3,847,234 A | | 11/1974 | Schumacher, Jr. et al. | 175/228 |

(List continued on next page.)

FOREIGN PATENT DOCUMENTS

| | | |
|---|---|---|
| GB | 1524914 | 9/1978 |
| GB | 2081775 | 2/1982 |

OTHER PUBLICATIONS

Smith Tool; Feature Bulletin; *Feature Leg Back Protection*; Exhibits 2–6; date: prior to filing of present application.

Sandvik Rock Tools; *Raise Boring Equipment*; Exhibits 7A and 7B; date: prior to filing of present application.

*Primary Examiner*—Hoang Dang
(74) *Attorney, Agent, or Firm*—Conley Rose, P.C.

(57) ABSTRACT

A rotary cone rock bit, comprises a bit body including a plurality of legs extending therefrom, each of the legs having an outer surface that includes a leading surface and a trailing surface, a roller cone rotatably supported on each of the legs, a bearing system between each cone and the leg on which it is supported, and a lubricant reservoir in fluid communication with the bearing system. The reservoir can be provided with a wear resistant plug, if desired. In the present bit, the reservoir has at least one opening positioned in either the leg's leading surface, trailing surface, center surface, shoulder surface or some combination of these. Alternatively, the reservoir can be formed inside the bit body, preferably by a canister or the like, which can be provided with a venting as desired.

16 Claims, 15 Drawing Sheets

U.S. PATENT DOCUMENTS

| | | | | | |
|---|---|---|---|---|---|
| 3,866,695 | A | | 2/1975 | Jackson | 175/228 |
| 3,917,028 | A | | 11/1975 | Garner | 184/6.14 |
| 4,014,595 | A | | 3/1977 | Dolezal | 308/8.2 |
| 4,019,785 | A | | 4/1977 | Stinson et al. | 308/8.2 |
| 4,055,225 | A | | 10/1977 | Millsapps | 175/228 |
| 4,102,419 | A | | 7/1978 | Klima | 175/371 |
| 4,199,856 | A | | 4/1980 | Farrow et al. | 29/454 |
| 4,274,498 | A | | 6/1981 | Penny | 175/228 |
| 4,276,946 | A | | 7/1981 | Millsapps, Jr. | 175/228 |
| 4,284,151 | A | | 8/1981 | Levefelt | 175/227 |
| 4,372,624 | A | | 2/1983 | Neilson | 384/94 |
| 4,386,667 | A | | 6/1983 | Millsapps, Jr. | 175/228 |
| 4,386,668 | A | | 6/1983 | Parish | 175/228 |
| 4,390,072 | A | | 6/1983 | Phelan | 175/229 |
| 4,399,878 | A | | 8/1983 | Karlsson et al. | 175/227 |
| 4,428,442 | A | | 1/1984 | Steinke | 175/228 |
| 4,428,687 | A | | 1/1984 | Zahradnik | 384/94 |
| 4,453,836 | A | | 6/1984 | Klima | 384/94 |
| 4,512,669 | A | | 4/1985 | Moore | 384/93 |
| 4,513,829 | A | | 4/1985 | Coates | 175/339 |
| 4,577,705 | A | | 3/1986 | Cross | 175/228 |
| 4,593,775 | A | | 6/1986 | Chaney et al. | 175/228 |
| 4,597,455 | A | | 7/1986 | Walters et al. | 175/228 |
| RE32,495 | E | | 9/1987 | Coates | 175/339 |
| 4,722,615 | A | * | 2/1988 | Bailey et al. | 175/369 |
| 4,793,719 | A | | 12/1988 | Crockett et al. | 384/92 |
| 4,911,255 | A | * | 3/1990 | Pearce | 175/368 |
| 4,981,182 | A | | 1/1991 | Dysart | 175/71 |
| 5,027,911 | A | | 7/1991 | Dysart | 175/57 |
| 5,148,879 | A | | 9/1992 | Hopper | 175/371 |
| 5,161,898 | A | | 11/1992 | Drake | 384/95 |
| 5,415,243 | A | | 5/1995 | Lyon et al. | 175/331 |
| 5,441,120 | A | | 8/1995 | Dysart | 175/228 |
| 5,454,437 | A | * | 10/1995 | Estes | 175/332 |
| 5,586,612 | A | | 12/1996 | Isbell et al. | 175/363 |
| 5,793,719 | A | | 8/1998 | Gardner et al. | 369/44.23 |
| 6,053,264 | A | * | 4/2000 | Frankel et al. | 175/367 |

* cited by examiner

PROTECTED LUBRICANT RESERVOIR FOR SEALED EARTH BORING DRILL BIT

RELATED APPLICATIONS

This is a divisional continuing application of U.S. patent application Ser. No. 09/484,860, filed Jan. 18, 2000, now U.S. Pat. No. 6,296,067, which is a divisional continuing application of U.S. patent application Ser. No. 08/925,869, filed Sep. 9, 1997 and now abandoned.

CROSS-REFERENCE TO RELATED APPLICATIONS

The present application claims the benefit of U.S. Provisional Application Serial No. 60/025,858, filed Sep. 9, 1996, and entitled Improved Rock Drill Bit, which is incorporated herein by reference, and of U.S. Provisional Application Serial No. 60/051,373 filed Jul. 1, 1997, and entitled Protected Lubricant Reservoir For Sealed Bearing Earth Boring Drill Bit.

STATEMENT REGARDING FEDERALLY SPONSORED RESEARCH OR DEVELOPMENT

Not applicable.

BACKGROUND OF THE INVENTION

The invention relates generally to sealed bearing earth boring drill bits, such as rotary cone rock bits, that utilize a fluid circulation medium. More particularly, the invention relates to such drill bits that include a protected lubricant reservoir.

More specifically, drill bits are generally known, and fall into at least two categories. Drill bits used for drilling petroleum wells and drill bits used in the mining industry are both well known in the art. While these two types of bits superficially resemble each other, the parameters that affect the operation of each are completely different. Petroleum drill bits typically use a viscous, heavy drilling fluid (mud) to flush the cuttings from the vicinity of the bit and carry them out of the hole, whereas mining bits typically use compressed air to achieve the same purpose. Petroleum bits typically drill deep holes, on the order of thousands of feet, and an average bit typically drills several hundreds or thousands of feet before being removed from the hole. In many instances, a petroleum bit is not withdrawn from the hole until it has exhausted its useful life. In contrast, mining bits are each used to drill several relatively shallow holes, typically only 30–50 feet deep, and must be withdrawn from each shallow hole before being shifted to the next hole. Thus, the effect of withdrawal and backreaming wear on the body of a mining bit are much more important considerations than they are for petroleum bits. In addition, because petroleum bits drill near the surface they are more frequently subjected to cave-ins, and must ream their way backwards out of the hole through the caved-in material. For these reasons, the factors that affect the design of mining bits are very different from those that affect the design of petroleum bits.

For instance, the viscosity and density of the drilling mud makes it possible to flush the cuttings from the hole even at relatively low fluid velocities. The air used to flush cuttings from mining holes, in contrast, is much less viscous and dense and therefore must maintain a rapid velocity in order to successfully remove the rock chips. This means that the cross-sectional area through which the air flows at each point along the annulus from the bit to the surface must be carefully maintained within a given range. Similarly, the rapid flow of air across and around a rock bit greatly increases the erosive effect of the cuttings, particularly on the leading portions of the bit.

Furthermore, rock bits are now being developed with sealed lubrication systems that allow easier rotation of the bit parts. These sealed lubrication systems typically comprise a lubricant reservoir in fluid communication with the bearings. In many cases, the reservoir is created by drilling a cavity into the bit leg. Access to the reservoir is through the installation opening of this cavity, which can then be sealed with a conventional plug or vented plug. These sealed lubrication systems are particularly vulnerable to erosion of the bit body, as any breach of the sealed system can result in the ingress of cuttings and/or particles into the bearings, causing bit failure. Heretofore, the reservoir opening has been located on the main outer face of each leg, with the result that the reservoir plugs and the walls of the reservoir itself are vulnerable to wear on the leg.

Hence it is desirable to provide a mining bit that provides increased protection for the reservoir and its installation opening and plug. It is further desired to provide a bit that is capable of withstanding wear on its shoulders and legs during backreaming or as the bit is being withdrawn from a hole.

BRIEF DESCRIPTION OF THE DRAWINGS

For a detailed description of the preferred embodiments of the invention, reference will now be made to the accompanying drawings wherein.

DESCRIPTION OF THE PREFERRED EMBODIMENTS

Figure 1:
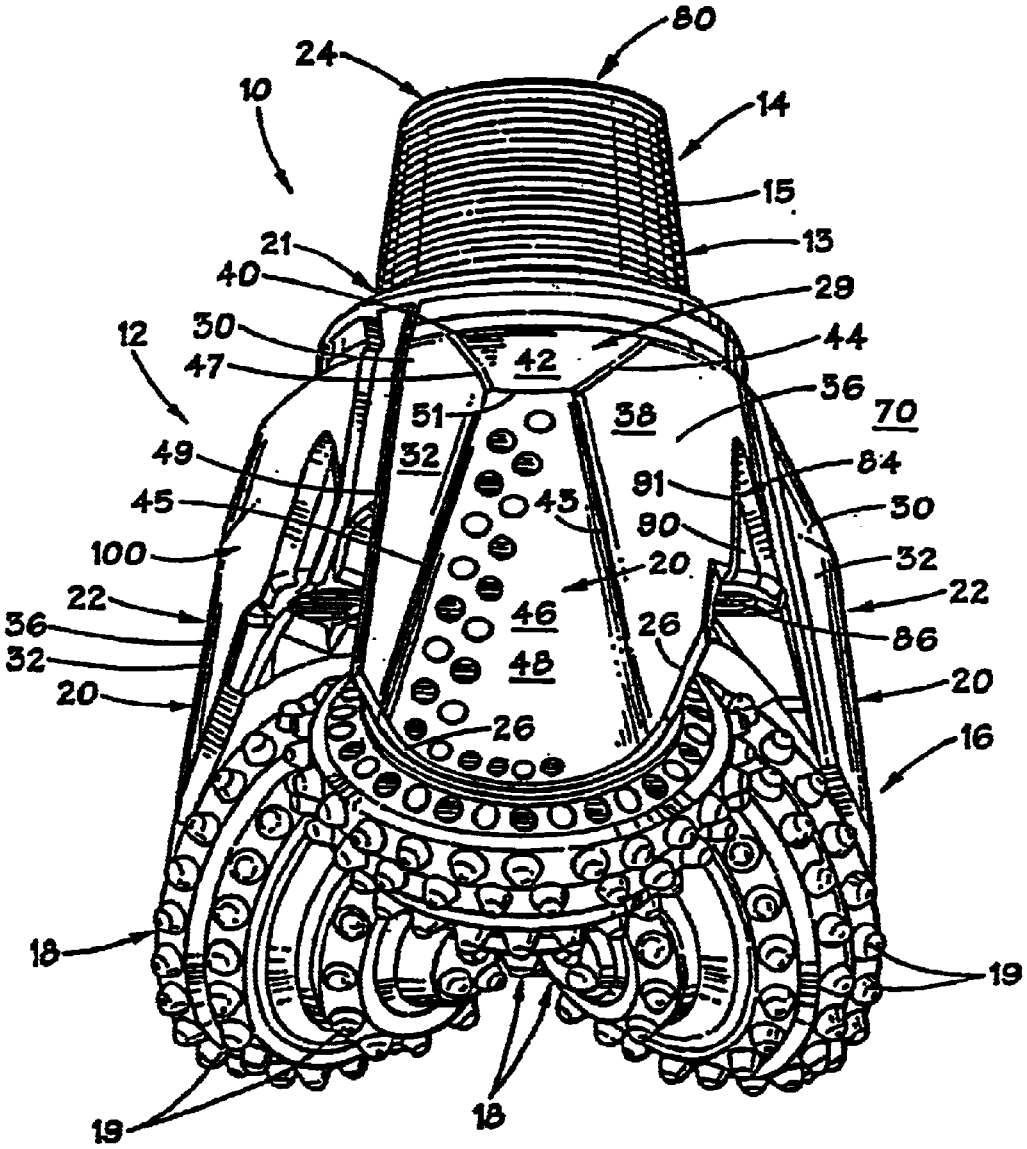
FIG. 1 is an isometric view of a rotary cone drill bit of the present invention.

Presently preferred embodiments of the invention are shown in the above-identified figures and described in detail below. In illustrating and describing the preferred embodiments, like or identical reference numerals are used to identify common or similar elements. The figures are not necessarily to scale and certain features and certain views of the figures may be shown exaggerated in scale or in schematic form in the interest of clarity and conciseness.

Figure 2:
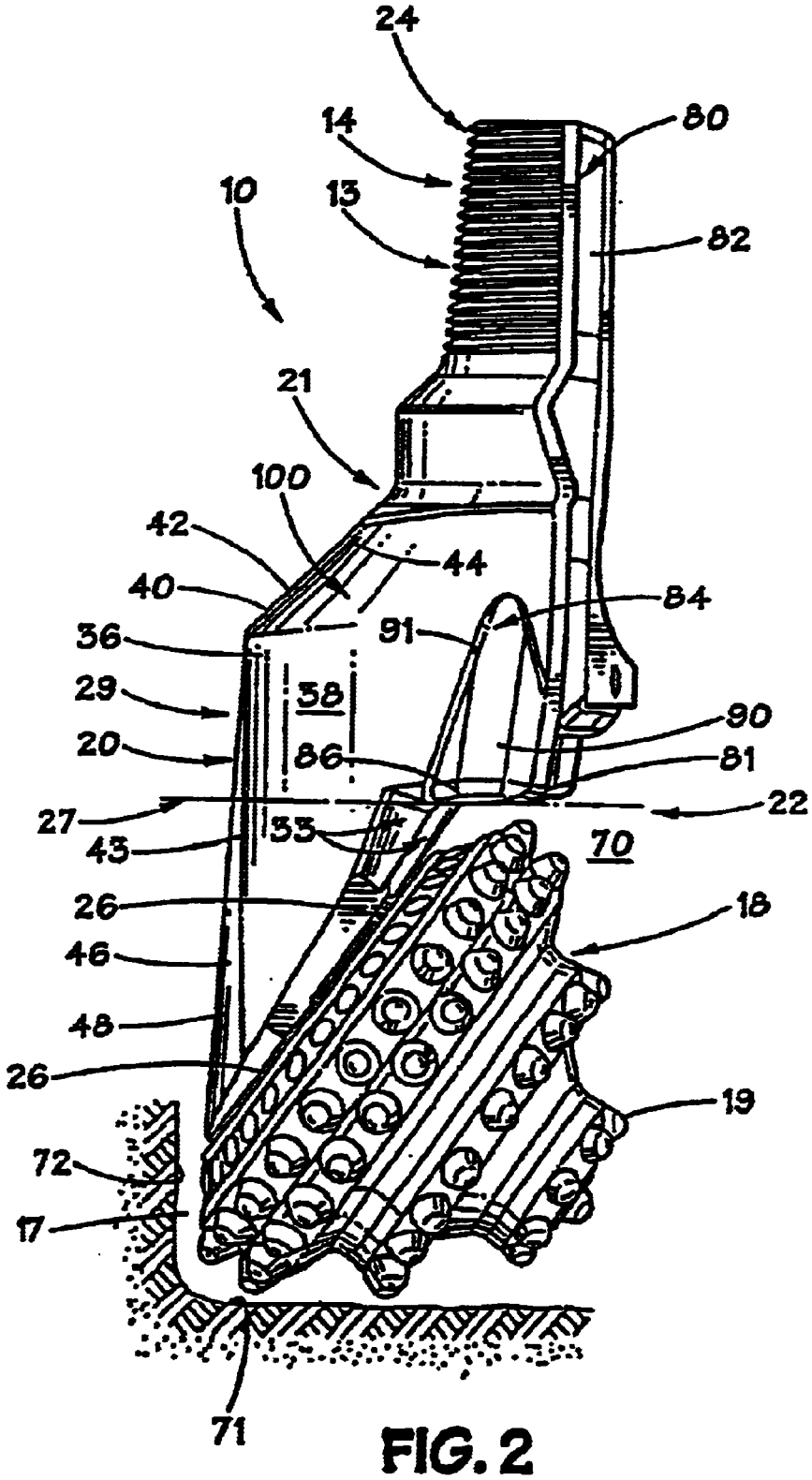
FIG. 2 is a side view of one leg of the drill bit of FIG. 1.

Referring initially to FIGS. 1–2, a sealed-bearing earth boring bit 10 is shown. The bit 10 illustrated is a rotary cone rock bit used for drilling blast holes in mining operations that utilizes fluid circulation to cool and clean the bit 10 and to transport earthen cuttings and debris up the bore hole to the surface (not shown). It should be understood that the present invention is not limited to rotary cone rock bits 10 for mining operations, but may be used in other types of sealed bearing earth boring drill bits for any other desirable earthen drilling applications, such as petroleum well, pipeline, sewage and electrical conduit drilling.

The bit includes a bit body 12, a pin end 14 and a cutting end 16. The pin end 14 includes a connector 13, such as a threaded pin connection 15, for connecting the bit 10 to a carrier, such as a drill string (not shown). The bit body 12 includes legs 20 extending generally between the pin end 14 and the cutting end 16 of the bit 10. At the cutting end 16, each leg 20 carries a cutter cone 18 having a multitude of protruding cutting elements 19 for engaging the earthen formation and boring the bore hole 17 as the bit in rotated in a clockwise direction when viewed from the pin end 14. Typically, rotary cone drill bits 10 have three legs 20 and cones 18, although the present invention may be used in bits 10 with any number of leg 20/cone 18 combinations. While portions of the description of the preferred embodiments of the present invention are made herein with reference to a single leg 20, such discussions apply equally to each leg 20 of a bit 10 in accordance with the present invention.

Still referring to FIGS. 1 and 2, a plenum 80, having a plenum surface 82 extends through the bit 10 to allow the supply of circulation fluid (not shown) to one or more nozzles 84 formed in legs 20, as is known in the art. The circulation fluid, such as gas or drilling mud, is provided into the plenum 80 from a fluid supply source (not shown) and through a supply conduit, such as a drill string (not shown), attached to the pin end 14 of the bit 10. Each nozzle 84 extends from the plenum 80 to a port 86, which opens to the exterior 70 of the bit 10, as is known in the art. A nozzle boss 90 is disposed on the leg 20 over the nozzle 84. The nozzles 84 operate to direct pressurized fluid against the bottom 71 of the bore hole 17 (FIG. 3) to lift earthen cuttings and other debris up through the bore hole 17. The nozzles 84 also direct the circulation fluid over the cones 18 and cutting elements 19 to free debris accumulating thereabout.

Figure 5:
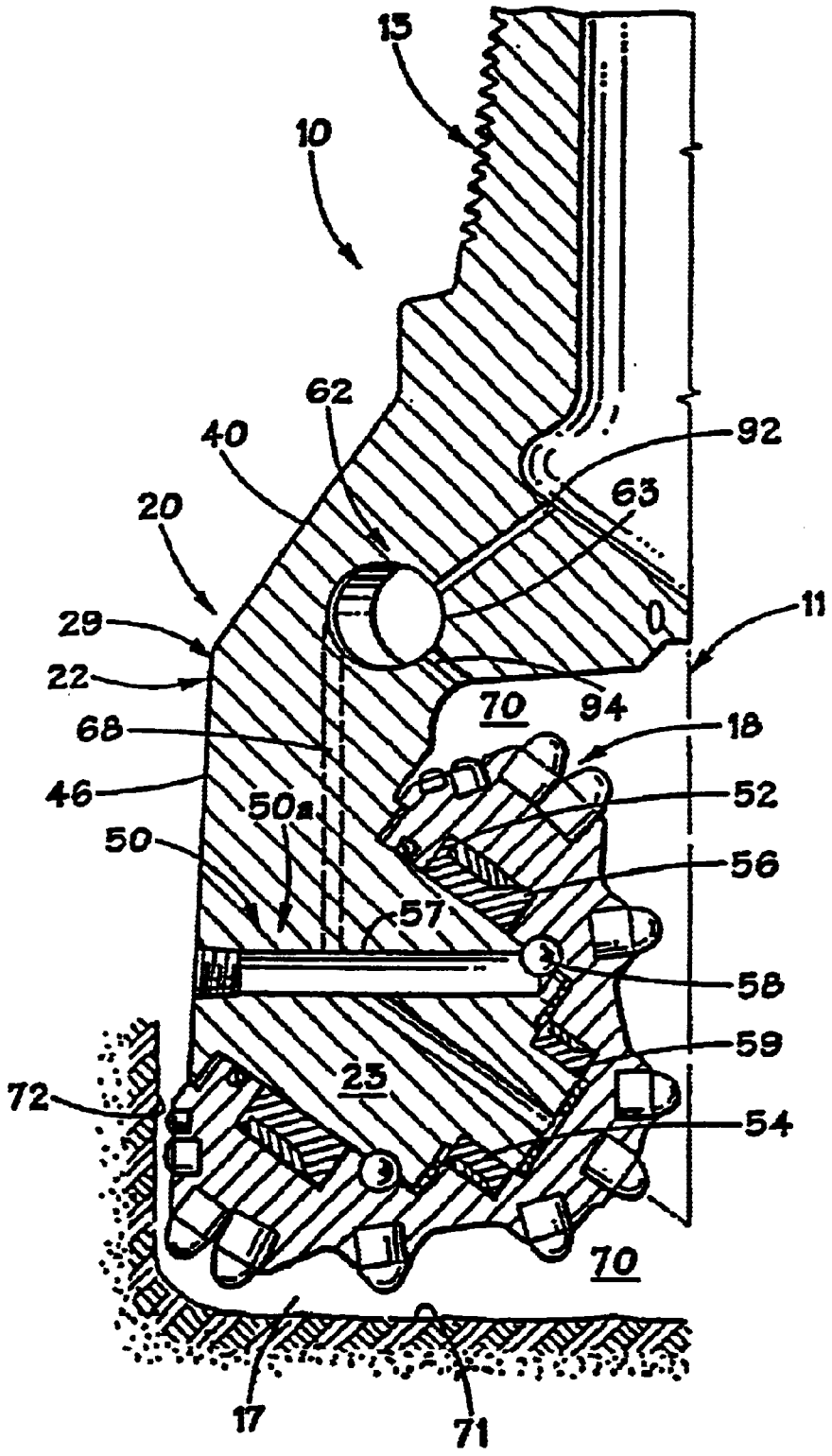
FIG. 5 is a cross-sectional view at plane 5—5 in FIG. 4.

Now referring to FIG. 5, the bit 10 includes a bearing system 50 for permitting rotation of the cone 18 about a journal 23 extending from the leg 20. The bearing system 50 may be a roller bearing system 50*a*, as is, or becomes, known in the art, such as the roller bearing system disclosed in U.S. Pat. No. 5,793,719 to Crockett et al., which is incorporated herein by reference in its entirety. The roller bearing system 50*a* includes various conventional roller bearing components, such as, for example, cone bearing surfaces 52, journal bearing surfaces 54, roller bearings 56 and locking balls 58, disposed in the interior 59 of the cone 18. A roller bearing system 50*a* compatible for use with the bit 10 of the present invention is also shown with respect to the prior art bit 10*a* of FIG. 3. Alternately, the bearing system 50 may be a friction bearing system 50*b* (FIG. 9) including conventional friction bearing system components as are or become known in the art. In either type of bearing system 50*a*, 50*b*, a locking ball loading hole 57 may be formed into the leg 20 for loading the locking balls 58 into the cone interior 59. A ball retaining plug 55 (FIG. 9) is typically disposed in the hole 57 for retaining the locking balls 58.

Figure 9:
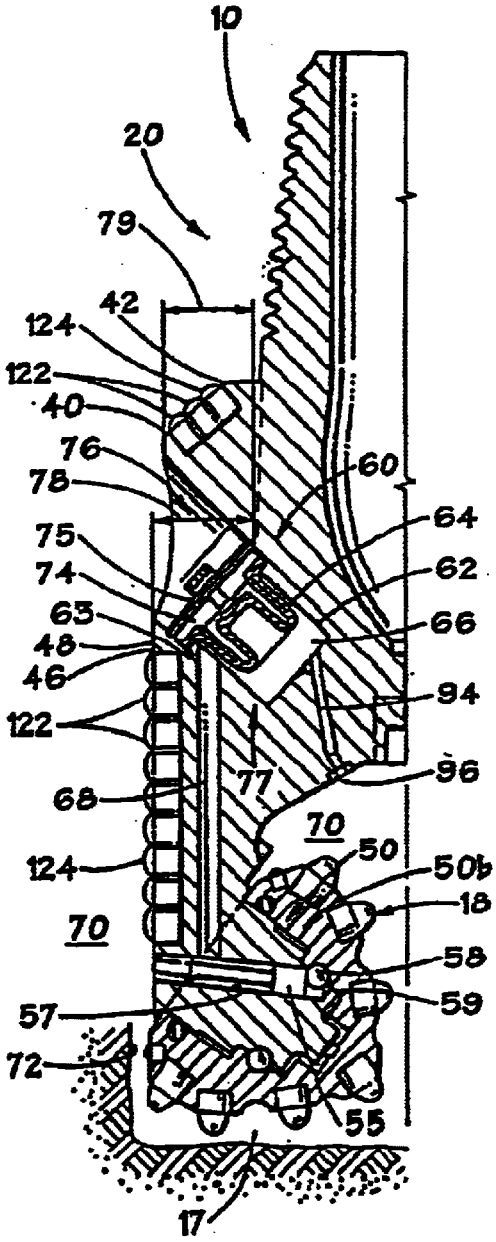
FIG. 9 is a cross-sectional view at plane 9—9 in FIG. 8.
Figure 10:
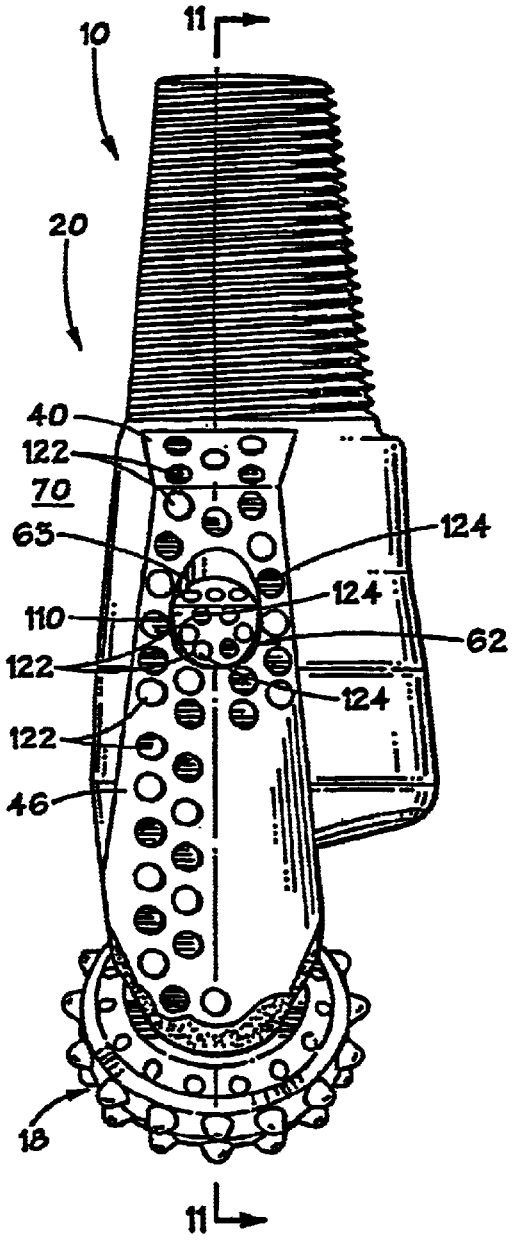
FIG. 10 is a front elevation view of one leg of a rotary cone drill bit having a fifth embodiment of a protected lubricant reservoir.
Figure 15:
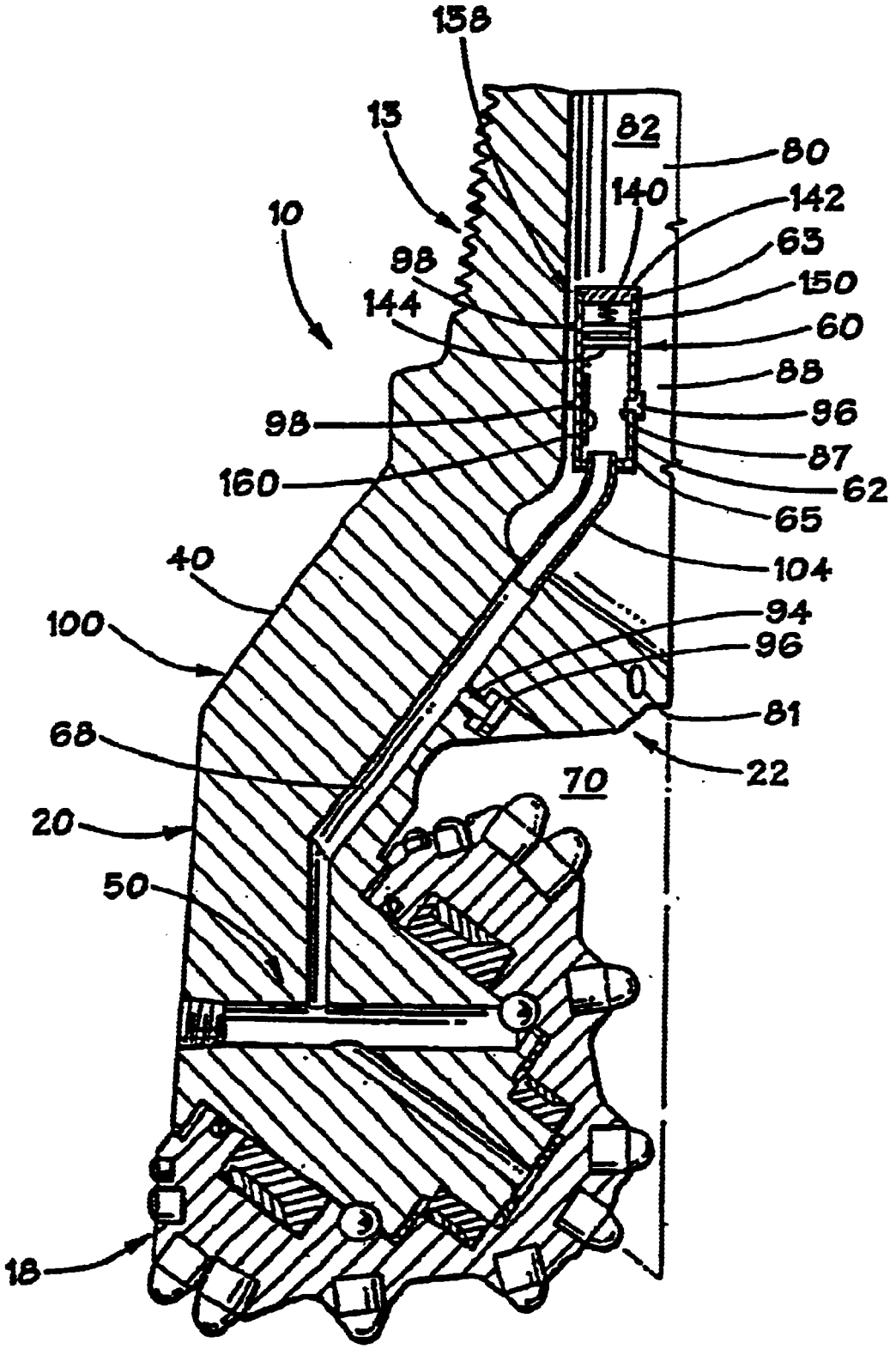
FIG. 15 is a cross-sectional view of one leg of a rotary cone drill bit having an eighth embodiment of a protected lubricant reservoir.
Figure 16A:
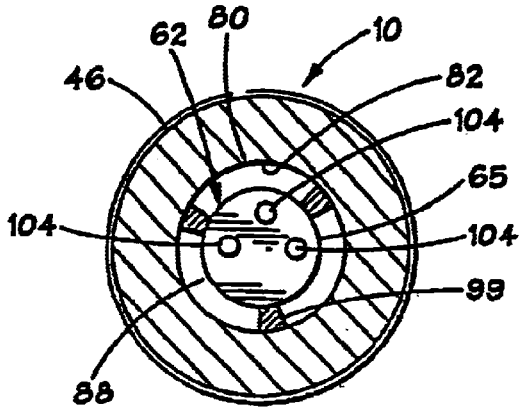
FIG. 16*a* is a cross-sectional view at plane 16*a*—16*a* in FIG. 16.
Figure 16:
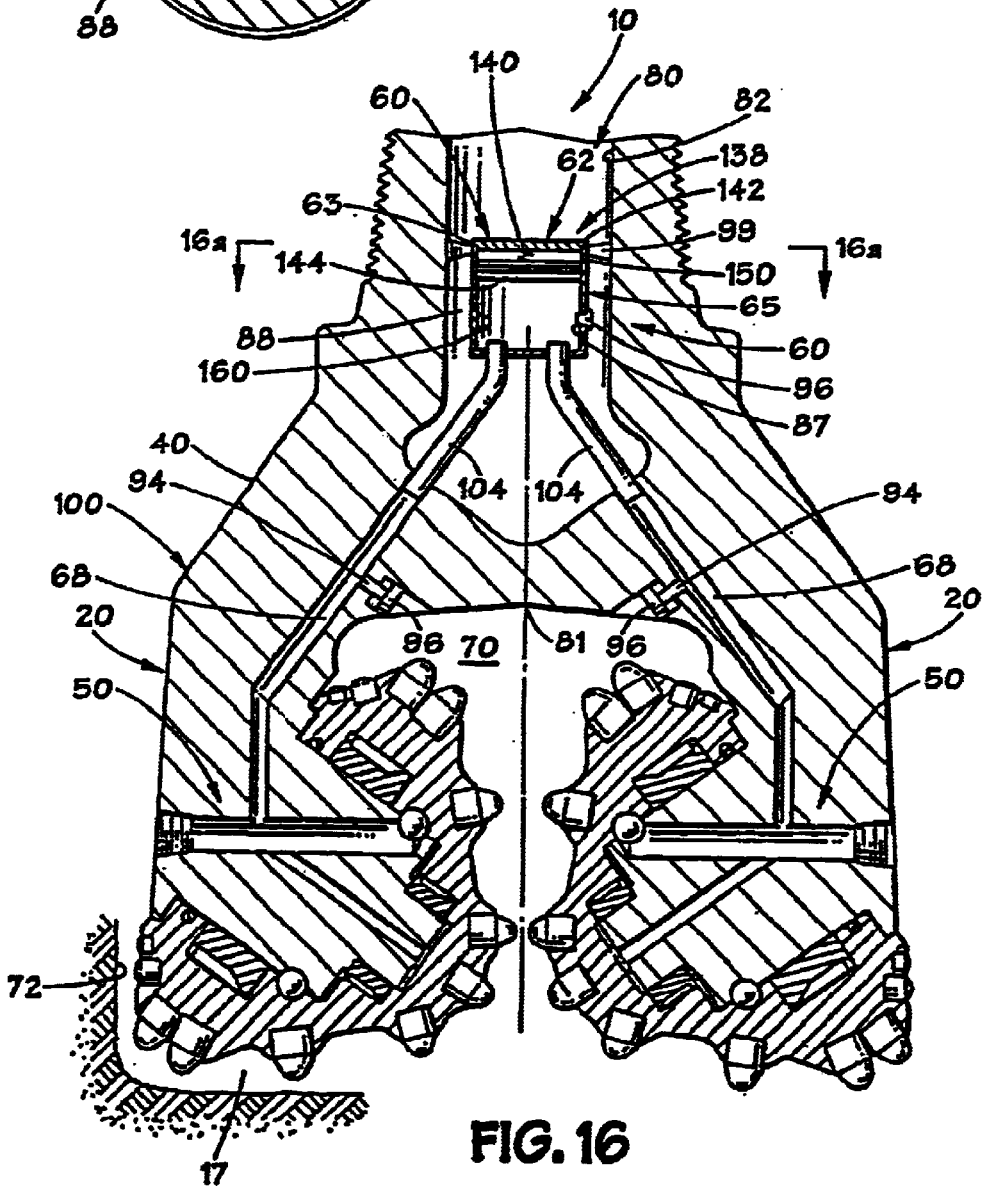
FIG. 16 is a cross-sectional view of a rotary cone drill bit having a ninth embodiment of a protected lubricant reservoir.
Figure 17:
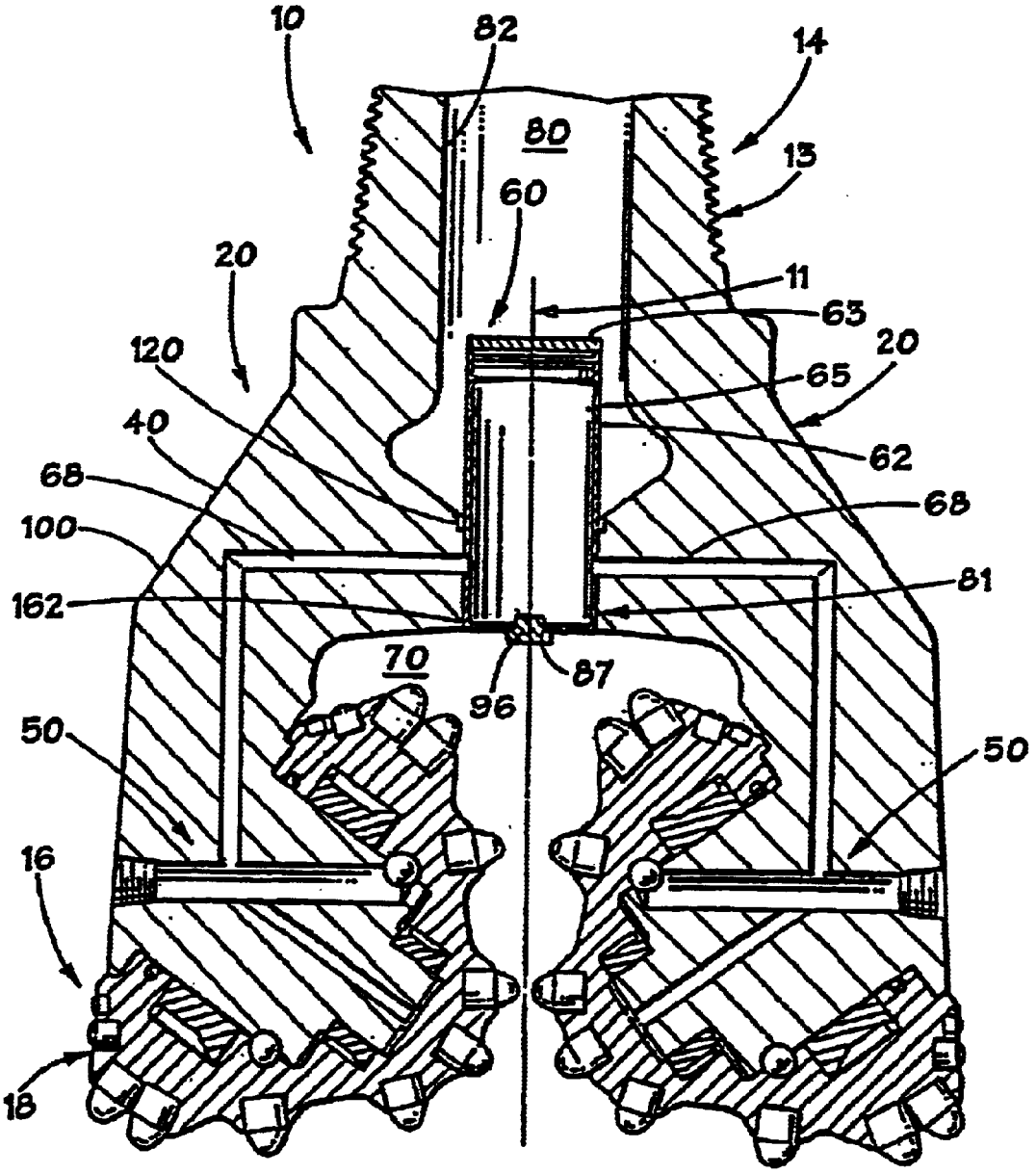
FIG. 17 is a cross-sectional view of a rotary cone drill bit having a tenth embodiment of a protected lubricant reservoir.
Figure 20:
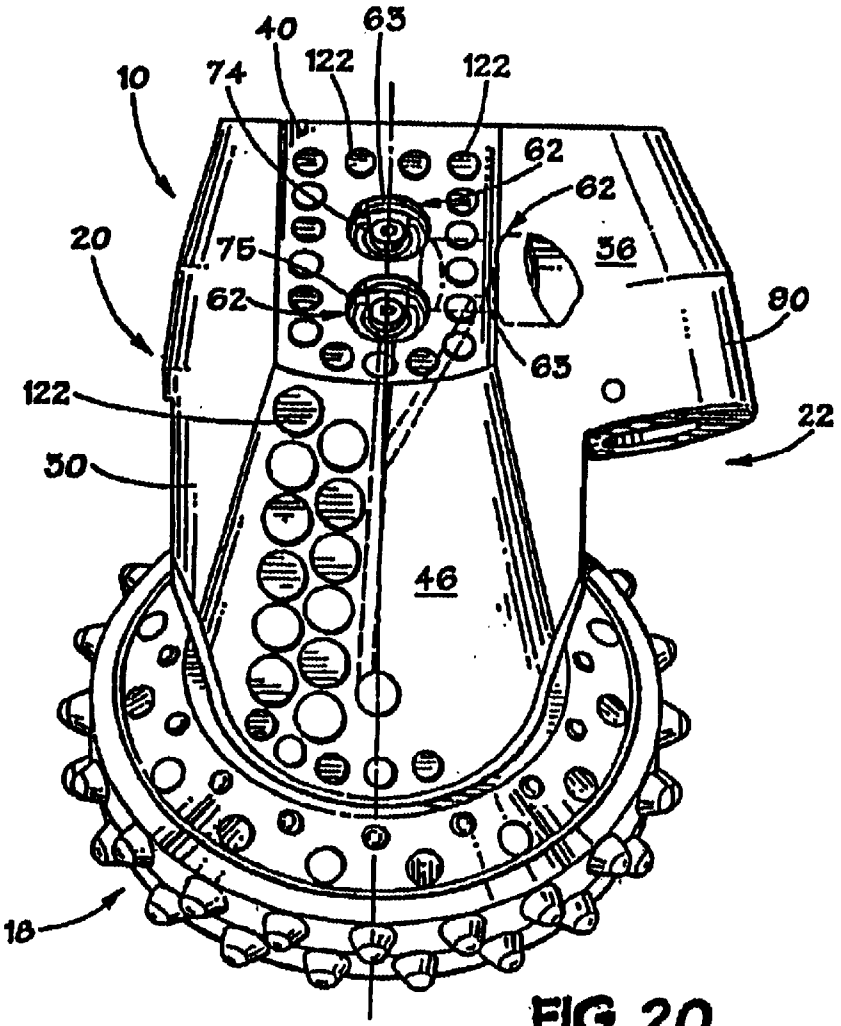
FIG. 20 is a front elevation view of one leg of a rotary cone drill bit having three protected lubricant reservoirs in accordance with the present invention.

Referring to FIG. 9, lubricant, such as grease (not shown), is provided to the roller bearing system 50 via a lubricant reservoir system 60. A reservoir system 60 compatible for use with the bit 10 of the present invention is also shown with respect to the prior art bit 10*a* of FIG. 3. The reservoir system 60 includes one or more reservoirs 62 disposed in the bit 10 for supplying the lubricant to the bearing system 50, such as through a lubricant passageway 68. Any desirable number of reservoirs 62 can be disposed in a single leg 20 or elsewhere in the bit 10. For example, FIG. 20 shows a leg 20 having three reservoirs 62, while FIGS. 15–17 show lubricant reservoirs 62 disposed in the bit plenum 80. While the following description of the preferred embodiments of the present invention is made, in part, with respect to a single reservoir 62, it may be applied equally to each reservoir 62 of a multiple reservoir leg 20, or bit 10.

Figure 11:
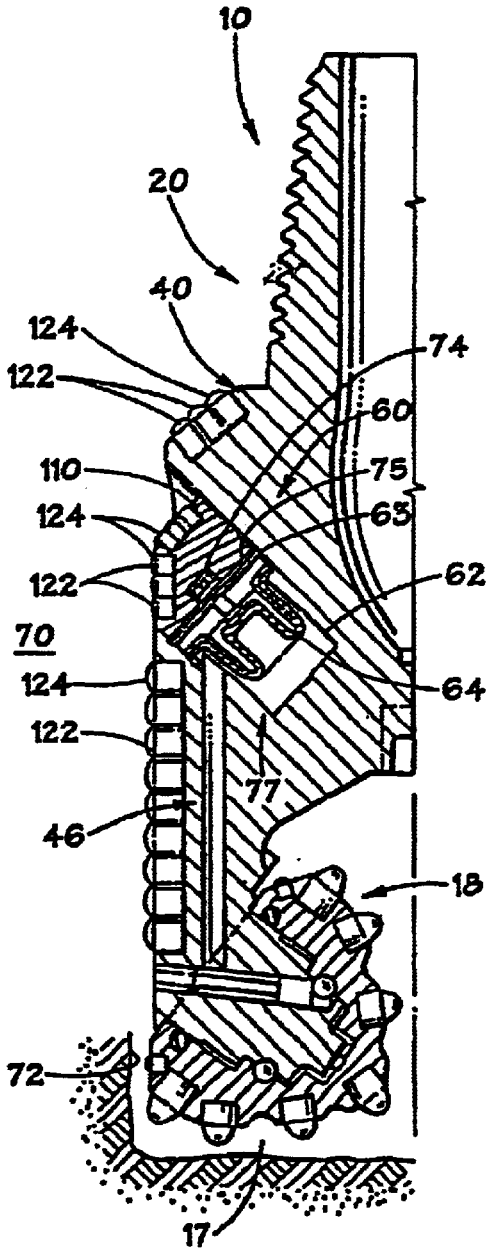
FIG. 11 is a cross-sectional view at plane 11—11 in FIG. 10.

Still referring to FIG. 9, the reservoir 62 typically contains various reservoir system components as are known in the art, such as, for example, a flexible membrane 64 that balances the pressure between the exterior 70 of the bit 10 and the lubricated, or lubricant carrying, side 66 of the bit 10. It should be understood, however, that the inclusion or non-use of reservoir system components in the reservoir 62 is not limiting on the present invention. To allow the insertion, or loading, of the lubricant and reservoir system components into the reservoir 62 during assembly of the bit 10, one end 76 of the reservoir is initially left accessible through a reservoir installation opening 63. After the lubricant and: reservoir system components are inserted, or loaded, into the reservoir 62, the installation opening 63 is typically sealed and covered, such as, for example, with a reservoir cover cap 74 held in place with a retaining, or snap, ring 75 for retaining the lubricant and reservoir system components in the reservoir 62 (see also the prior art bit 10*a* of FIG. 3). The opposite end 77 of the reservoir 62 typically forms a blind hole in the leg 20 (FIG. 11).

Again referring to FIG. 9, the reservoir system 60 may be configured to relieve the expansion, or excess volume, of lubricant (not shown) contained therein. Again, any suitable technique or mechanism as is or becomes known in the art may be utilized. For example, the reservoir 62 can be configured such that there is sufficient space (not shown) in the reservoir 62 for the lubricant to expand therein, as is known in the art. For another example, excess lubricant in the reservoir system 60 may be vented from the reservoir 62. Any suitable conventional technique may be used. For example, excess lubricant can be vented through the flexible membrane 64, as is known in the art. Another example of venting excess lubricant from the reservoir system 60, as shown in FIG. 9, is through a vent duct 94 extending from the reservoir 62 to the bit exterior 70, in accordance with the present invention. According to the present invention, the opening of vent duct 94 can be located on the throat surface, the leading surface, the trailing surface, the shoulder surface, or the center panel surface, although it is preferred that the vent duct opening not be on the same surface as installation opening 63. A control device, such as a conventional pressure relief valve 96, may be included to enable the controlled venting of lubricant from the reservoir system 60.

It should be understood that the aforementioned operations, configurations, components and methods have been provided to assist in understanding the context of the invention and are not necessary for operation of the invention.

Now referring to FIG. 1, each leg 20 of the bit body 12 of the bit 10 of the present invention includes a leading side 30, a trailing side 36, a shoulder 40 and a center panel 46. The leading side 30 has an outer surface 32, the trailing side 36 has an outer surface 38, the shoulder 40 has an outer shoulder surface 42 and the center panel 46 has an outer backturn surface 48. Surfaces 32, 38, 42, 48 form part of the outer surface 100 of the leg 20. In the embodiment shown, for example, the leading side surface 32 extends generally from the lower end 21 of the connector 13 to the lower edge 26 of the leg 20 between the edges 45, 47 of the center panel 46 and shoulder 40, respectively, and the edge 49 of the leg 20. The trailing side surface 38 extends generally from the lower end 21 of the connector 13 to the lower edge 26 of the leg 20 between edge 91 of the nozzle boss 90 and edges 43, 44 of the center panel 46 and shoulder 40, respectively. The shoulder surface 42 is shown extending from the lower end 21 of the connector 13 to the upper edge 51 of the center panel 46 between the leading and trailing sides 30, 36 at edges 47, 44, respectively. Finally, the backturn surface 48 extends between edges 45, 43 and 51 and the lower edge 26 of the leg 20.

Still referring to FIG. 1, as the bit 10 rotates during operations, the leading side 30 of each leg 20 leads the clockwise rotational path of the leg 20 followed by the shoulder 40 and center panel 46, which are followed by the trailing side 36. During drilling, as well as extraction of the bit 10 from the bore hole 17 (FIG. 2), the bit legs 20 will contact earthen cuttings (not shown) in the bore hole 17 and may also contact the bore hole wall 72 (FIG. 2). Generally, the leading side 30, leg shoulder 40 and center panel 46 of each leg 20 will experience such contact, while the trailing side 36 is substantially blocked from significant contact with earthen cuttings and the bore hole wall 72 by the surfaces 32, 42 and 48 and the leg mass 29. Depending on various factors, such as the composition of the earthen formation being drilled, contact between the surfaces 100 of the legs 20 and earthen cuttings (and the bore hole wall) will cause varying degrees of wear and damage to the legs 20. During backreaming in hard, or rocky, earthen formations, for example, the legs 20, particularly the leg shoulders 40 and leading sides 30, may be subject to significant contact with rock cuttings, causing significant erosive wear, cracking and fracturing of the bit legs 20.

Figure 3:
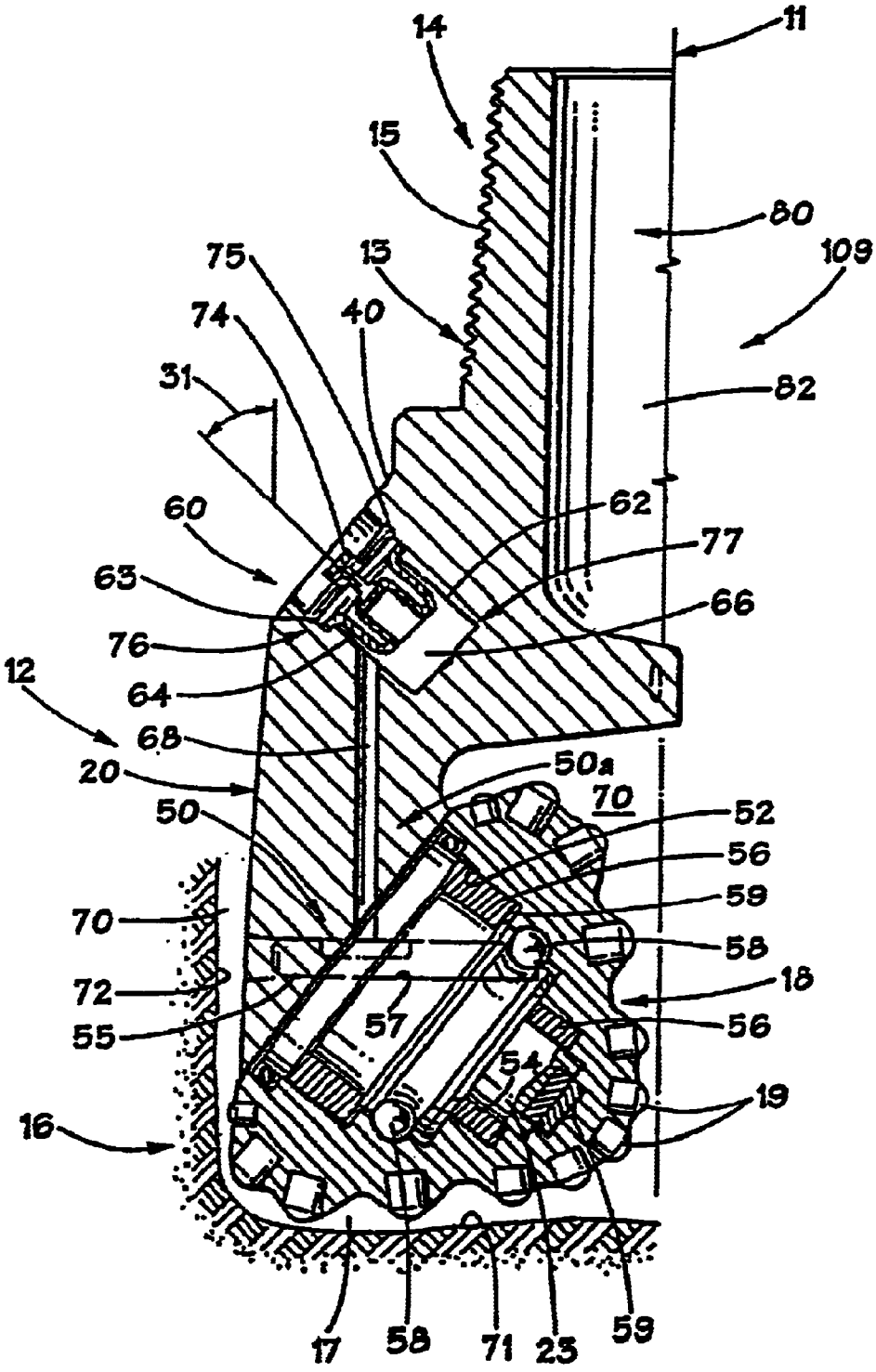
FIG. 3 (PRIOR ART)
FIG. 3 is a cross-sectional view of a rotary cone drill bit of the prior art in a bore hole.

Referring to the prior art bit 10*a* of FIG. 3, it is a concern that damage to the bit legs 20 as described above can lead to damage to the lubricant reservoir 62, which can lead to premature bit failure. For example, the introduction of foreign material, such as earthen cuttings, into the reservoir or bearing systems 60, 50, will lead to contamination and deterioration of the lubricant and the reservoir and bearing system components, causing premature bit failure. It is thus an object of the present invention to provide improved protection of the reservoir 62 and reservoir opening 63 from damage caused by contact between the bit 10 and earthen cuttings (and the bore hole wall) during drilling and bit extraction.

In prior art bits 10*a*, as shown in FIG. 3, the reservoir installation opening 63 was typically located on the leg shoulder 40, or across the intersection of the shoulder and center panel (not shown), facing angularly upwardly relative to the bore hole wall 72, or from the central axis 11 of the bit 10*a*. For example, a typical prior art bit reservoir opening 63 located on the shoulder 40 was oriented with its axis at an angle 31 of about 75 degrees or less relative to the central axis 11 of the bit 10*a*. The prior art reservoir opening 63 orientation has been known to subject the reservoir opening 63 and reservoir 62 to damage as described above, particularly during backreaming.

Figure 4:
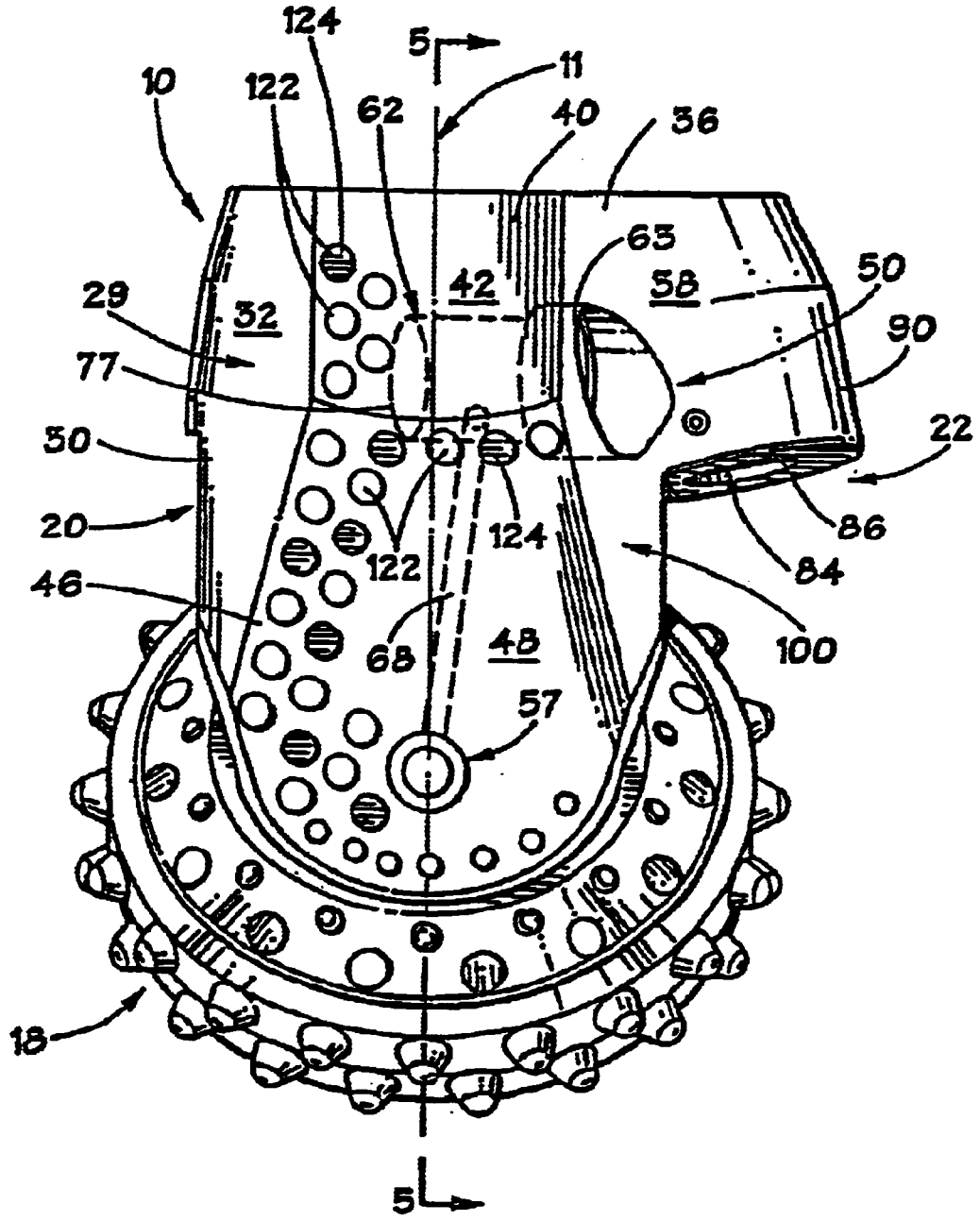
FIG. 4 is a front elevation view of one leg of a rotary cone drill bit having a first embodiment of a protected lubricant reservoir.
Figure 7:
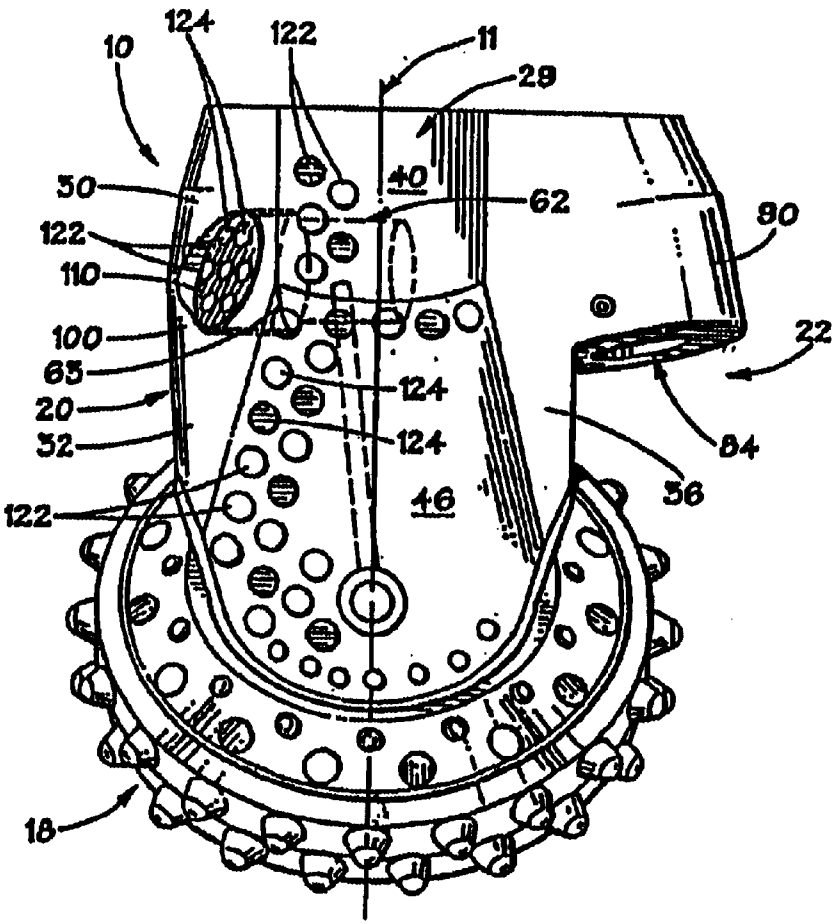
FIG. 7 is a front elevation view of one leg of a rotary cone drill bit having a third embodiment of a protected lubricant reservoir.
Figure 8:
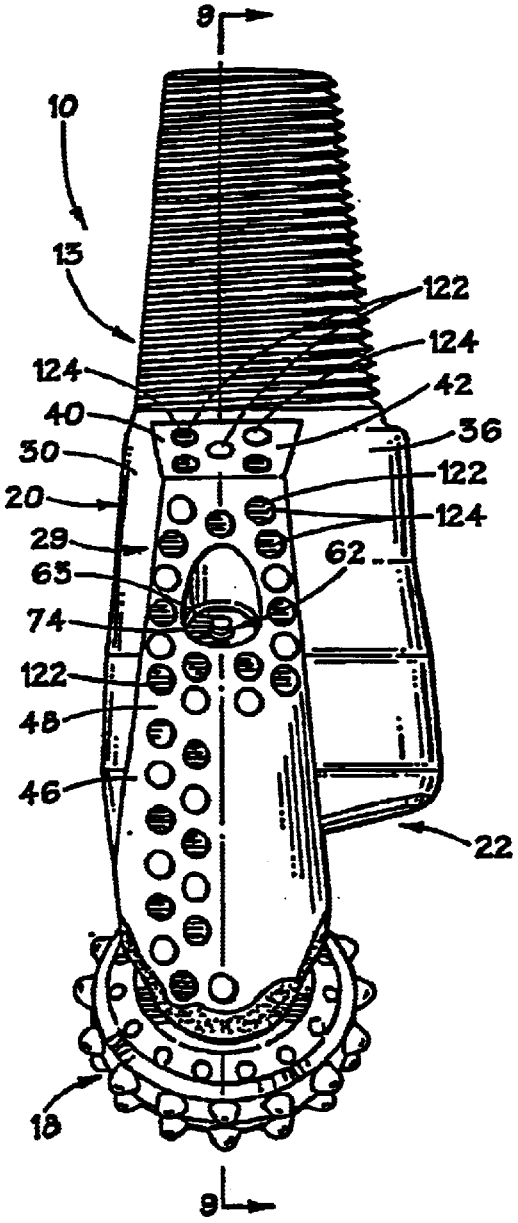
FIG. 8 is a front elevation view of one leg of a rotary cone drill bit having a fourth embodiment of a protected lubricant reservoir.

It should be understood that each of the following aspects of the invention may be utilized alone or in combination with one or more other such aspects. In one aspect of the invention, the installation opening 63 is accessible from the outer leg surface 100, but located so as to decrease the susceptibility of the reservoir 62 and opening 63 to damage from contact between the leg 20 and bore hole debris, or the bore hole wall 72 (FIGS. 4, 7, 8). The installation opening 63 can be disposed anywhere on the leading side 30 (FIG. 7), trailing side 36 (FIG. 4) or center panel 46 (FIG. 8). In accordance with this aspect, as the bit 10 rotates in the bore hole 17, particularly during extraction and backreaming, the reservoir installation opening 63 is generally more substantially blocked, or protected, from contact with the bore hole wall 72 and earthen cuttings in the bore hole 17 by the leg mass 29, as compared to the prior art location of the installation opening 63 on the leg shoulder 40 (FIG. 3). In the preferred embodiments shown, the reservoir installation opening 63 is disposed above the bit throat level 22. The "bit throat level" 22 refers to the cross-section of each leg 20 and the bit 10 taken generally along line 27 (FIG. 2), which extends proximate to the level of the nozzle ports 86. The "bit throat" 33, also shown in FIG. 2, refers to the interior, or facing, portions of each leg 20 between its lower edge 26 and the lower end 81 of the bit plenum 80. However, the opening 63 may, in accordance with this aspect of the invention, also be disposed at, or below, the bit throat level 22.

Figure 21:
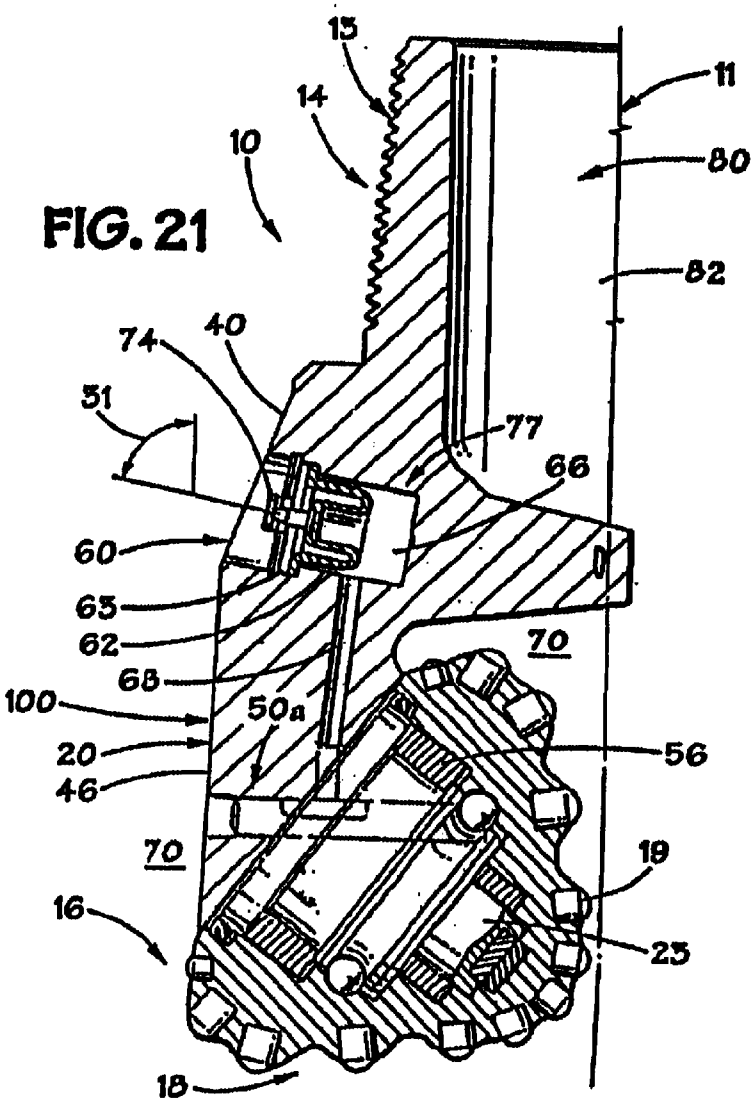
FIG. 21 is a cross-sectional view of one leg of a rotary cone drill bit having yet another embodiment of a protected lubricant reservoir.

In another aspect of the invention, the reservoir 62 may be oriented so that the installation opening 63 is on the outer surface 100 of leg 20, but is oriented on the shoulder 40 (FIG. 21) so that it axis is at an angle 31 of between about 76 degrees and about 180 degrees relative to the central axis 11 of the bit 10, or disposed at any angular orientation anywhere on the leading side 30 (FIG. 7), trailing side 36 (FIG. 4), or center panel 46 (FIG. 8) of leg 20. For example, the opening 63 in FIGS. 4 and 7 are on the trailing and leading sides 36, 30, respectively, oriented generally perpendicularly relative to the central axis 11 of the bit 10, respectively. In FIG. 21, the opening 63 is oriented at an angle 31 of about 81 degrees relative to the central axis 11 of the bit 10.

In a further aspect of the invention, as shown, for example, in FIGS. 4, 7 and 8, the reservoir 62 and installation opening 63 may be isolated from contact with bore hole debris and the bore hole wall by recessing the installation opening 63 into the leg 20. The reservoir opening 63 of the leg 20 of FIG. 4, for example, is shown recessed into the trailing side 36 of the leg 20, while the opening 63 of FIG. 7 is recessed in the leading side 30. In FIG. 8, the reservoir installation opening 63 is shown recessed into the center panel 46. The installation opening 63 thus lies recessed relative to the shoulder and backturn surfaces 42, 48, respectively, and is shielded thereby and by the leg mass 29. Further, the leg 20 may be configured so that the shoulder 40 serves as a protective ledge above the installation opening 63, as shown, for example, in FIG. 9. In FIG. 9, the shoulder 40 extends radially outwardly from the leg 20 toward the bore hole wall 72 relative to the reservoir opening 63 by a distance 79 equal to between about 50% and about 100% of the exposed radial dimension 78 of the reservoir opening 63, substantially blocking the reservoir opening 63 from contact with bore hole debris during backreaming. Alternatively, the extended shoulder may be constructed as a separate piece that is rigidly affixed to said bit body, as shown in phantom in FIG. 9.

In yet another aspect of the present invention, a protective plug 110 may be emplaced over the reservoir opening 63, as shown, for example, in FIGS. 7, 10–13. The plug 110 protects the installation opening 63 and reservoir 62 by serving as an outer contact and wear surface and by absorbing impact energy from contact with bore hole debris and the bore hole wall 72 (FIG. 11). The plug 110 may be any suitable size and configuration, and may be constructed of any suitable material having strength, or wear, characteristics similar to, or better than, steel. For example, referring to FIG. 13, the plug 110 may have a thickness 152 of about 10% or greater of its diameter or smallest width 154. Any suitable technique may be used to connect the plug 110 to the bit 10, such as by welding, matable members or mechanical connectors (not shown). Still referring to FIG. 13, the bit 10 may be configured so that the plug 110 rests upon a plug base 112 formed into the leg 20, whereby the base 112 absorbs energy from impact force to the plug 110 during drilling and bit extraction. Further, a gap 113 may be formed between the plug 110, or plug base 112, and reservoir opening 63 to allow space for the accumulation of excess lubricant from the reservoir 62, or to isolate the reservoir 62 from the plug 110. A bleed hole (not shown) may be formed in the plug 110, or the leg 20, and extends to the exterior 70 of the bit 10 to allow the venting of excess lubricant from the gap 113.

Figure 14:
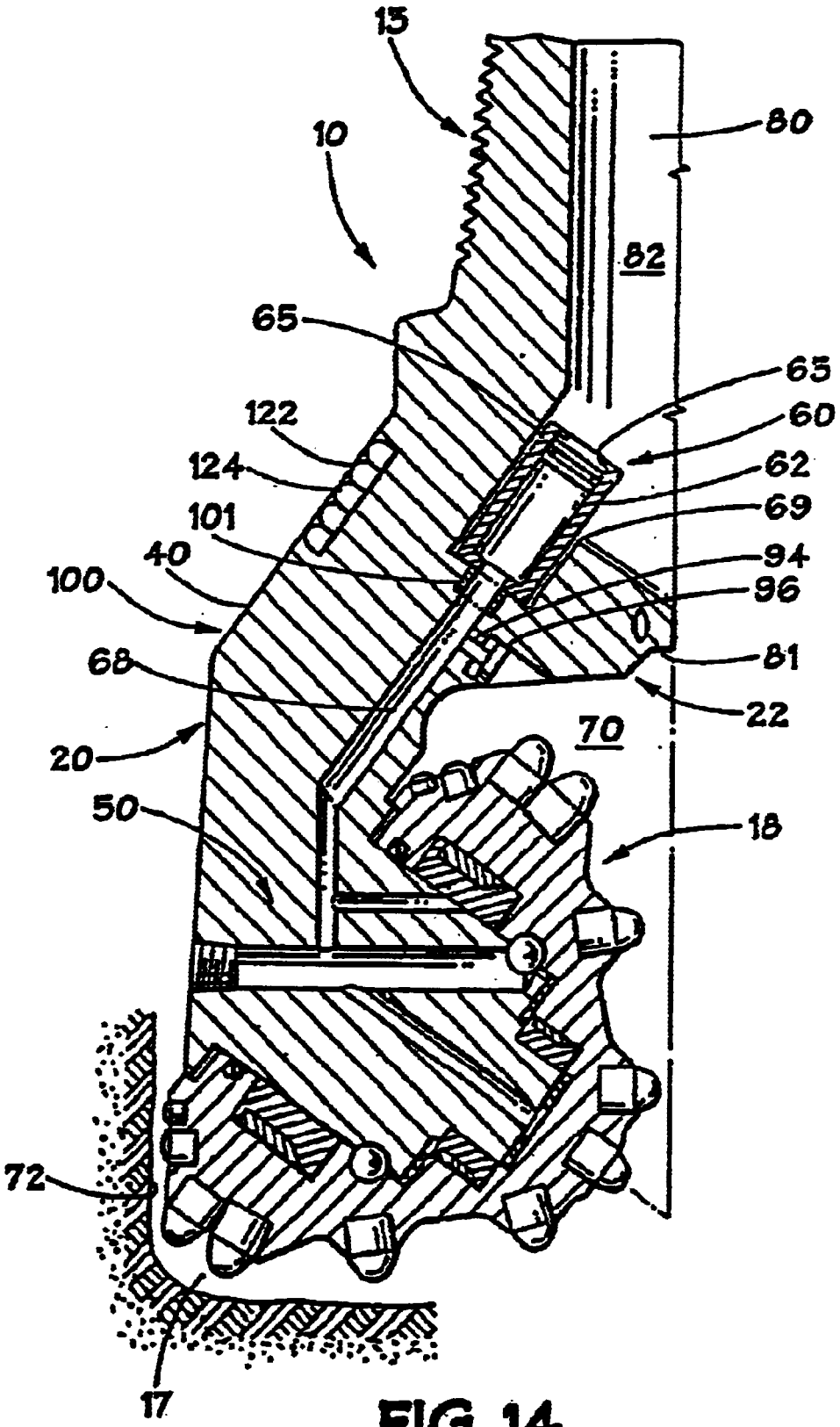
FIG. 14 is a cross-sectional view of one leg of a rotary cone drill bit having a seventh embodiment of a protected lubricant reservoir.

Alternately, the installation opening 63 may be entirely isolated from the outer surface 100 of the legs 20, as shown, for example, in FIGS. 14–18, to reduce the susceptibility of damage to the reservoir 62 and opening 63 from contact between the bit 10 and bore hole debris or the bore hole wall 72. FIGS. 14–17, for example, show the reservoir 62 configured so that the reservoir opening 63 opens to the bit plenum 80. In FIG. 14, the reservoir 62 and installation opening 63 are accessible via the plenum 80 and communicate with bearing system 50 of leg 20, such as through lubricant passageway 68. The reservoir 62 is shown as a reservoir housing 65 disposed in a cavity, or receiving pocket, 69 formed in the leg 20. The housing 65 may be any suitable container, such as a canister, having any form and construction suitable for use as a reserved 62 is described above or as known in the art. When a housing 65 is used, it is inserted into the cavity 69 or otherwise formed into bit leg 20 during assembly of the bit 10 and may be connected to the bit 10 with any suitable conventional technique, such as a threaded matable connector 101, retaining rings, pins, or by weld (not shown). The reservoir 62, however, need not be a housing 65, but can take other suitable forms. For example, the cavity, or receiving pocket, 69 can itself be used as the reservoir 62.

In FIGS. 15–17, the reservoir 62, such as housing 65 as described above, is located within the bit plenum 80. The reservoir housing 65 is mounted to the plenum surface 82 with pins 98 (FIG. 15), brackets 99 (FIG. 16, 16*a*) or any other suitable conventional technique, such as by weld or retaining rings (not shown). The reservoir 62 may be capable of supplying the bearing system 50 of a single leg 20, as shown, for example, in FIG. 15, or multiple legs (FIGS. 16, 17). Further, the reservoir system 60, such as shown in FIGS. 15 and 16, may include tubes 104 that connect the reservoir 62 with the leg bearing systems 50, such as through passageways 68. As illustrated in FIG. 16*a*, the reservoir system 60 may have numerous tubes 104 for supplying lubricant to numerous bit legs (not shown).

Referring to the embodiment shown in FIG. 17, the reservoir 62 may be located generally proximate to the lower end 81 of the plenum 80 and in direct communication with the passageways 68 of legs 20 for supplying lubricant to the bearing systems 50. The reservoir 62, such as housing 65, may be easily installed into an assembled bit 10 by inserting the reservoir 62 into the plenum 80 at the pin end 14 of the bit 10 and securing it with any suitable conventional technique, such as with a centralizing ring 120, or by weld. Alternately, the reservoir 62 may be easily installed through a bore 162 in the lower end 81 of the plenum 80. Using this method, once the reservoir 62 is positioned as desired, the bore 162 and reservoir 62 may be welded together at the lower end 81 of the plenum 80 to secure the reservoir 62 in the bit 10 and, if desired, to substantially seal the plenum 80.

When the installation opening 63 opens to the bit plenum 80, such as shown in FIGS. 14–17, the reservoir system 60 may be configured to allow the flow of circulating fluid through the entire length of the plenum 80. For example, a gap 88 (FIGS. 15, 16) can be formed between the reservoir 62 and the plenum surface 82. For another example, the reservoir 62 can include a fluid bypass annulus (not shown), such as when the reservoir 62 is formed with a donut-shape (not shown).

Excess lubricant may be vented from the reservoir system 60 with any suitable technique, such as those described above, if venting is desired. For example, excess lubricant may be vented through a vent passage 94 extending from the passageway 68 (FIGS. 14–16) to the bit exterior 70. Excess lubricant may additionally, or alternately, be vented from the reservoir 62 into the plenum 80 (FIGS. 15, 16) or to the bit exterior 70 (FIG. 17), such as through a vent hole 87 in the reservoir housing 65. Further, the vent passageway 94 or vent hole 87 may be equipped with a control device, such as a pressure relief valve 96, to enable the controlled venting of lubricant from the reservoir system 60. The reservoir system 60 may also, or alternately, be equipped with a piston vent 138 (FIGS. 15, 16) disposed within the reservoir 62, or housing 65. The piston vent 138 includes a piston member 144 and biasing member, such as a spring 140, connected between the cover, or end, 142 of the reservoir 62 and the piston member 144. The piston member 144 substantially sealingly engages the interior wall 160 of the reservoir 62. Pressure changes in the reservoir 62 will cause the piston member 144 to move upwardly and downwardly therein. When the pressure within the reservoir or housing 65 forces the piston member 144 above predetermined height, or level, of 3 bleed hole 150 in the reservoir 62 excess lubricant and pressure in the reservoir system 60 is released into the plenum 80 through the bleed hole 150. It should be understood, however, that the venting of excess lubricant from the reservoir system 60 with these or any other methods and structure is not required for, or limiting upon, the present invention.

Figure 18:
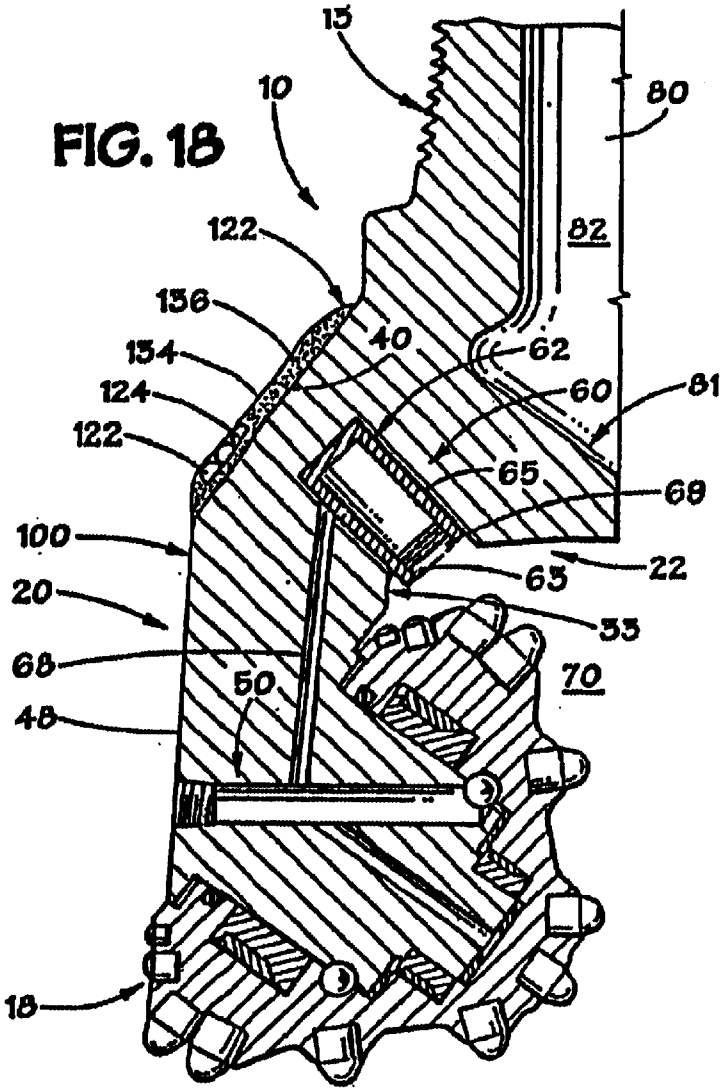
FIG. 18 is a cross-sectional view of one leg of a rotary cone drill bit having an eleventh embodiment of a protected lubricant reservoir.

In another configuration of the present invention, such as shown in FIG. 18, the reservoir opening 63 is located in the proximity of the bit throat 33. The reservoir 62 communicates with the leg bearing system 50, such as through passageway 68. By opening to the bit exterior 70 in the proximity of the bit throat 33, the reservoir 62 and reservoir opening 63 are isolated and protected from contact between the bit 10 and bore hole debris and the bore hole wall. The reservoir 62 is shown in FIG. 18 having a housing 65 (as described above) disposed in a cavity, or receiving pocket, 69 formed in the leg 20. The reservoir 62, such as the housing 65, may be connected to the bit 10 with any suitable conventional technique, such as a threaded mateable connector, retaining rings, pins, or by weld (not shown). The reservoir 62, however, need not include a housing 65, but can take any suitable form or configuration. For example, the cavity 69 can serve as the reservoir 62.

Figure 6:
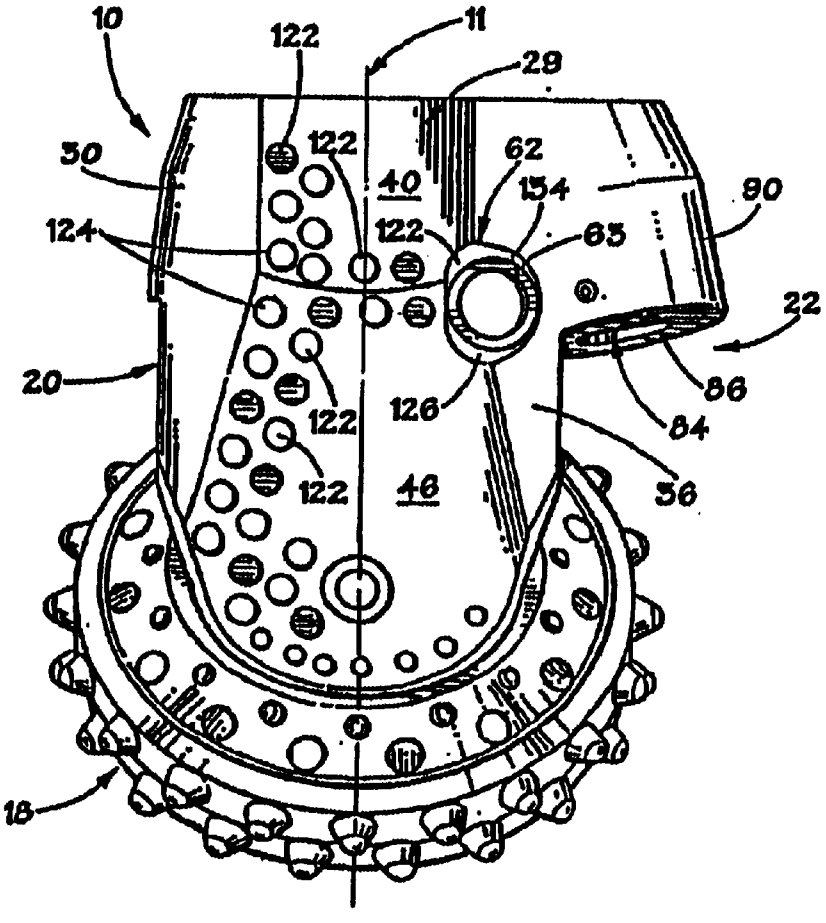
FIG. 6 is a front elevation view of one leg of a rotary cone drill bit having a second embodiment of a protected lubricant reservoir.
Figure 19:
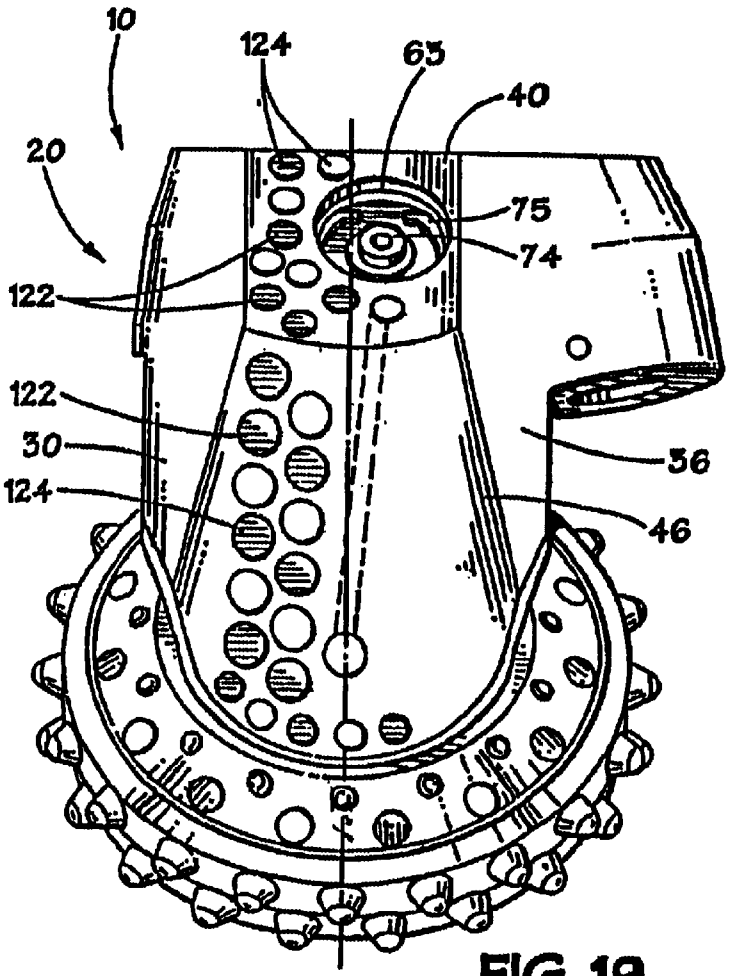
FIG. 19 is a front elevation view of one leg of a rotary cone drill bit having a twelfth embodiment of a protected lubricant reservoir.

In a further aspect of the invention, a hard, wear resistant material 122 may be incorporated into, or upon, the bit 10 to strengthen the bit 10 and inhibit erosive wear and contact damage to the bit 10, reservoir 62 and reservoir opening 63, as shown, for example in FIGS. 6 and 19. The hard wear resistant material 122 may have any suitable shape and size and may be set flush with (FIG. 14), protrude from (FIG. 9), or be recessed (not shown) in the outer surface 100 of one or more legs 20 of the bit 10, as is desired. Further, the hard wear resistant material 122 may be attached to the bit 10 with any suitable technique that is or becomes known in the art.

The term "hard wear resistant material" as used herein generally includes any material, or composition of materials, that is known or becomes known to have strength, or wear, characteristics equal to or better than steel, and which can be affixed onto, or formed into, the drill bit 10. The hard wear resistant material 122 may, for example, be inserts 124 (FIG. 4), as are known in the art for strengthening and inhibiting wear to the bit 10. Inserts 124 may also be used for engaging and grinding loose rock in the bore hole during operations, such as disclosed in U.S. Pat. No. 5,415,243 to Lyon et al., which is incorporated herein by reference in its entirety. The inserts 124 may be tungsten carbide inserts, inserts constructed of a tungsten carbide substrate and having a natural or synthetic diamond wear surface, or inserts constructed of other suitable material. Any type of insert that is, or becomes, know for use with drill bits may be used with the present invention, such as "flat-top," dome shaped, chisel shaped and conical shaped inserts. The inserts 124 may be embedded into the bit 10 as is known in the art or otherwise attached to the bit 10 with any suitable technique. For another example, the hard wear resistant material 122 may be hard facing, or deposits 134, such as the guard member 136 of FIG. 18. As shown in FIG. 18, the hard facing or deposits 134, such as the guard member 136, may itself carry inserts 124. The hard facing or deposits 134 are applied to the bit 10 with any suitable technique, such as by being brazed or welded thereto.

The hard wear resistant material 122 can be placed at any location on the bit 10 as is desirable for assisting in protecting the reservoir 62 and reservoir opening 63. As shown, for example, in FIGS. 14 and 18, the material 122 can be located on the bit 10 outward of the entire reservoir system 60 relative to the bore hole wall 72. FIG. 14 shown inserts 124, while FIG. 18 shows guard member 136, each located on the shoulder 40 to assist in protecting the reservoir 62 and reservoir system 60 located within the leg 20. For another example, hard wear resistant material 122, such as inserts 124, can be embedded into, or attached to, the plug 110 of the present invention, such as shown in FIGS. 7, 10–13.

Figure 13:
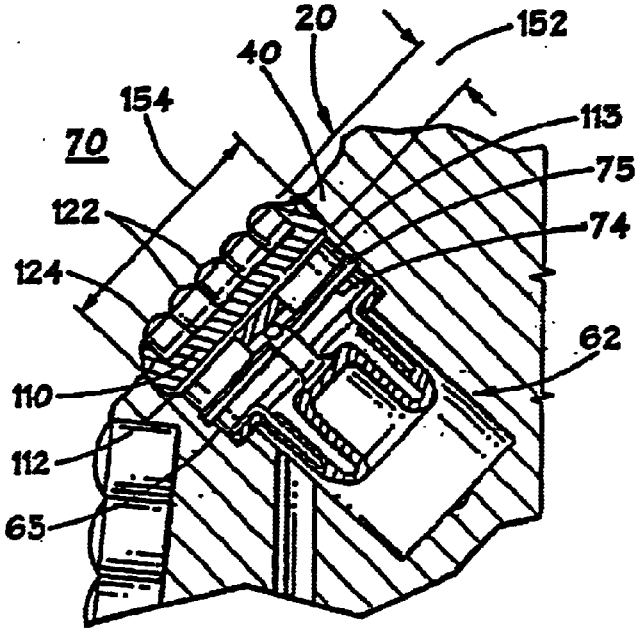
FIG. 13 is an exploded view of the protected lubricant reservoir of FIG. 12.
Figure 12:
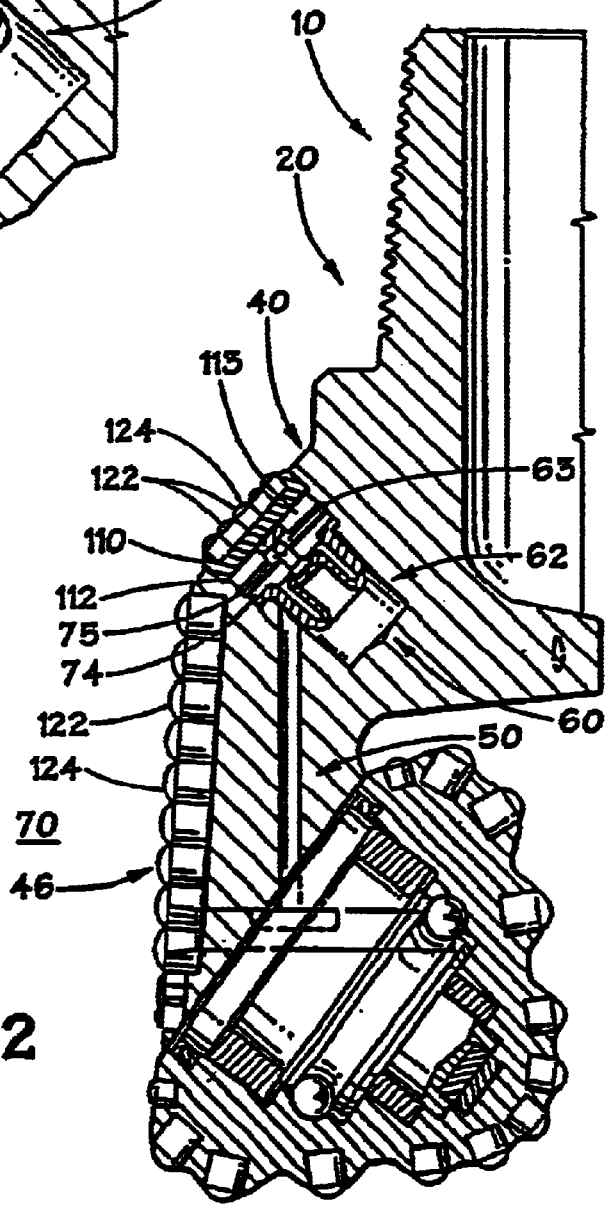
FIG. 12 is a cross-sectional view of one leg of a rotary cone drill bit having a sixth embodiment of a protected lubricant reservoir.

When the reservoir installation opening 63 opens to the leg surface 100, hard wear resistant material 122 may be used to protect the reservoir 62 and installation opening 63. For example, a protective ledge, or protrusion, 126 of hard wear resistant material 122, such as shown in FIG. 6, may be strategically formed into or attached to the leg 20, such as above or around the installation opening 63. The protrusion 126 may be connected to the bit 10 with any suitable conventional method, such as by welding or mechanical attachment means (not shown). For another example, hard wear resistant material 122, such as inserts 124, may be placed anywhere on the outside surface 100 of the leg 20 to assist in protecting the reservoir 62 and installation opening 63 (FIGS. 6, 12). FIGS. 4 and 7 shows the use of hard wear resistant material 122, such as inserts 124, on the shoulder 40 and center panel 46 when the installation opening 63 is on the trailing and leading sides 36, 30, respectively. FIG. 20 illustrates an example of the use of inserts 124 in conjunction with a leg 20 having two reservoir openings 63 on the shoulder 40 and a third installation opening 63 on the trailing side 36. Other examples of legs 20 having inserts 124 on the surface 100 when the installation opening 63 is on the shoulder 40 are shown in FIGS. 12, 13 and 19. In FIG. 6, the installation opening 63 is shown located at the intersection of the shoulder 40, center panel 46 and trailing side 36 of the leg 20 within a protrusion 126. Hard wear resistant materials 122, such as inserts 124, are strategically disposed on the leg 20, such as on the shoulder 40 and center panel 46, to protect the reservoir 62 and installation opening 63. FIGS. 8 and 11 show examples of the use of hard wear resistant material 122, such as inserts 124, to assist in protecting the reservoir 62 and installation opening 63 when the installation opening 63 is on the center panel 46. It should be understood, however, that the particular arrangements, locations and quantities of hard wear resistant material 122, such as inserts 124, shown in the appended drawings are not limiting on the present invention.

Each of the foregoing aspects of the invention may be used alone or in combination with other such aspects. While preferred embodiments of the present invention have been shown and described, modifications thereof can be made by one skilled in the art without departing from the spirit or teachings of this invention. The embodiments described herein are exemplary only and are not limiting of the invention. Many variations and modifications of the embodiments described herein are thus possible and within the scope of the invention. Accordingly, the scope of protection is not limited to the embodiments described herein.

What is claimed is:

1. A rotary cone rock bit, comprising:

a bit body including a plurality of legs extending therefrom, each of said legs having an outer surface that includes a leading surface, a center panel surface, a trailing surface and a shoulder;

a roller cone rotatably supported on each of said legs;

a sealed and lubricated bearing system between each cone and the leg on which it is supported; and a lubricant reservoir in fluid communication with said bearing system, said reservoir having an installation opening positioned completely within one of said center panel surfaces;

wherein a portion of said shoulder extends radially outwardly above said opening a first distance that is approximately equal to between about 50% and about 100% of the radial dimension of said opening and wherein said extended shoulder portion comprises a separate piece that is rigidly affixed to said bit body.

2. The bit according to claim 1 wherein said bit has a longitudinal axis and said installation opening is oriented so that its axis is at an angle of at least 76 degrees relative to said central axis.

3. The bit according to claim 1 wherein said extended shoulder portion includes a hard wear resistant material thereon.

4. The bit according to claim 1, further including a protective plug in said installation opening, said plug including a hard, wear resistant material on its outer surface.

5. The bit according to claim 1, further including a protective plug in said installation opening, said plug having a diameter and a thickness that is about 10% or greater of said diameter.

6. The bit according to claim 1, further including a protective plug in said installation opening, said plug having a thickness that is about 10% or greater of the smallest diameter of said opening.

7. The bit according to claim 1 wherein each of said legs includes a throat surface and said reservoir further includes a vent duct opening in said throat surface.

8. The bit according to claim 1 wherein said reservoir further includes a vent duct opening in said leading surface.

9. The bit according to claim 1 wherein said reservoir further includes a vent duct opening in said shoulder surface.

10. The bit according to claim 1 wherein said reservoir further includes a vent duct opening in said center panel surface.

11. The bit according to claim 1 wherein said center panel and shoulder surfaces each include a hard, wear resistant material thereon.

12. A rotary cone rock bit, comprising:

a bit body including a plurality of legs extending therefrom, each of said legs having an outer surface that includes a leading surface, a center panel surface, a trailing surface and a shoulder;

a roller cone rotatably supported on each of said legs;

a sealed and lubricated bearing system between each cone and the leg on which it is supported; and a lubricant reservoir in fluid communication with said bearing system, said reservoir having an installation opening positioned completely within one of said center panel surfaces;

wherein said bit body includes a plenum therein and said reservoir has a vent duct opening in said plenum so as to allow pressure in said plenum to force lubricant in said reservoir toward said bearing system.

13. The bit according to claim 12, further including a protective plug in said installation opening, said plug including a hard, wear resistant material on its outer surface.

14. The bit according to claim 12, further including a protective plug in said installation opening, said plug having a diameter and a thickness that is about 10% or greater of said diameter.

15. The bit according to claim 12, further including a protective plug in said installation opening, said plug having a thickness that is about 10% or greater of the smallest diameter of said opening.

16. The bit according to claim 12, wherein said center panel and shoulder surfaces each include a hard, wear resistant material thereon.

* * * * *